US008782974B1

(12) United States Patent
Potts

(10) Patent No.: US 8,782,974 B1
(45) Date of Patent: Jul. 22, 2014

(54) EASY SPLIT DOOR AND WINDOW FRAME AND MOUNTING BRACKET

(76) Inventor: Thomas Lee Potts, Houston, TX (US)

( * ) Notice: Subject to any disclaimer, the term of this patent is extended or adjusted under 35 U.S.C. 154(b) by 0 days.

(21) Appl. No.: 13/167,542

(22) Filed: Jun. 23, 2011

Related U.S. Application Data

(60) Provisional application No. 61/357,841, filed on Jun. 23, 2010.

(51) Int. Cl.
*E06B 1/02* (2006.01)

(52) U.S. Cl.
USPC ..... 52/204.1; 52/217

(58) Field of Classification Search
USPC ..... 52/204.1, 204.56, 211, 212, 213, 217, 52/698, 713
See application file for complete search history.

(56) References Cited

U.S. PATENT DOCUMENTS

| | | | | |
|---|---|---|---|---|
| 2,651,814 | A * | 9/1953 | Lester, Jr. | 49/380 |
| 3,564,774 | A * | 2/1971 | Lickliter et al. | 49/504 |
| 3,808,759 | A * | 5/1974 | Carmichael | 52/212 |
| 4,395,855 | A * | 8/1983 | Juker | 52/212 |
| 4,813,204 | A * | 3/1989 | Rentschler | 52/217 |
| 4,878,325 | A * | 11/1989 | Van Tuyl et al. | 52/217 |
| 5,154,019 | A * | 10/1992 | Day | 49/504 |
| 5,365,697 | A * | 11/1994 | Vanderpan | 49/380 |
| 5,581,953 | A * | 12/1996 | Ruff | 49/504 |
| 5,934,030 | A * | 8/1999 | McDonald | 52/204.1 |
| 6,550,193 | B2 * | 4/2003 | Potts | 52/204.1 |
| 7,516,581 | B2 * | 4/2009 | Vidal | 52/204.1 |
| 7,856,786 | B2 * | 12/2010 | Beck et al. | 52/650.1 |
| 8,069,622 | B2 * | 12/2011 | Mees et al. | 52/213 |
| 2003/0046886 | A1 * | 3/2003 | Potts | 52/212 |
| 2004/0226231 | A1 * | 11/2004 | Dlubak | 52/204.1 |
| 2005/0193653 | A1 * | 9/2005 | Cornell | 52/204.1 |
| 2006/0048466 | A1 * | 3/2006 | Darnell | 52/204.1 |
| 2006/0254163 | A1 * | 11/2006 | Vidal | 52/217 |
| 2010/0115864 | A1 * | 5/2010 | de La Fontaine et al. | 52/217 |

FOREIGN PATENT DOCUMENTS

| | | | | |
|---|---|---|---|---|
| GB | 2023208 | A * | 12/1979 | E06B 3/16 |

* cited by examiner

*Primary Examiner* — Charles A Fox
*Assistant Examiner* — James Buckle, Jr.
(74) *Attorney, Agent, or Firm* — Karen B. Tripp

(57) ABSTRACT

A split jamb for a door, window or vent comprising a support frame and a trim frame brought together and mounted using at least one bracket of the invention. The bracket comprises two connecting L-shaped pieces, one of which receives a hinge or a latch.

8 Claims, 7 Drawing Sheets

EASY SPLIT DOOR AND WINDOW FRAME AND MOUNTING BRACKET

RELATED APPLICATION

The present application claims priority from U.S. Provisional Patent Application Ser. No. 61/357,841, filed Jun. 23, 2010.

TECHNICAL FIELD AND BACKGROUND OF THE INVENTION

The invention relates to a support frame apparatus for supporting doors, windows, vents and other similar objects within an opening in a structure. The apparatus is of the type commonly referred to as a "split door jamb," or "split door jamb frame" in which two jamb members are provided and are connected to each other from opposite openings of a doorway. Typically, the jamb members are hollow and metal, and a door is hinged to a side jamb of one of the mating jamb members. The present invention provides an improved split door jamb, with an improved bracket for holding the hinge, and a method of using same. It should be noted that the term "split door jamb" is used in this specification as a reference and is not intended to limit the scope of the invention.

There are basically two distinct types of structures in which split door jambs are used—masonry structures and non-masonry constructed structures. Masonry structures include concrete masonry units, brick, stone, poured in place concrete, pre-cast concrete and any other poured or cast component structure. Non-masonry structures include wood framing, steel framing, composite material framing, and any other structure not of masonry construction.

Each of the two environments listed above have different industry accepted methods of installation. Door and window frames in masonry constructed structures must be braced in the exact position, plumb and square, and must remain in that precise position as the masonry construction is completed around the supported frame. This procedure is very labor intensive as accuracy is essential for the proper operation and installation of the door, window or other component. It is quite common for misalignment to occur due to the braced frame being hit and moved during the masonry construction. Furthermore, the hits and scratches sustained by the frame during the construction process significantly increase the risk of rusting thereby requiring time consuming cleaning before the finish can be applied to the frame.

In many cases, access must be provided to allow filling the hollow metal jamb members with a cementaceous material to obtain rigidity. Any variation between the thickness of the masonry structure becomes very apparent at the point where the masonry wall meets the jamb members. In addition, the cementaceous fill is problematic when holes must be drilled into the jamb members to mount hardware thereon. The installer must drill through the jamb members and continue drilling into the cementaceous fill to allow the proper clearance for the screws to seat properly and not strip out. This activity causes the installer to use up an excessive number of expensive bits and often produces holes that are not suitable for screw retention.

In non-masonry construction, any deviation in the structure thickness will cause problems during the finishing process. A split door jamb installed during the "framing" period of construction is subject to being hit or moved out of plumb and square arrangement. If a split door jamb is to extend beyond the wall structure thickness, then the split door jamb must be installed and the structure surfaces must be finished up to the jamb members. This often results in the area where the jamb members and wall structure meet to be a weak point in the finish, causing problems in the life of the structure.

In an effort to overcome and eliminate the aforementioned problems, a split jamb for doors and windows was conceived and is the subject of U.S. Pat. No. 6,550,193 of Thomas Lee Potts, issued Apr. 22, 2003. The door frame of this patent is a significant improvement over the prior art, but it contemplates manufacture and use of specific size frames and requires skill for installation, particularly for leveling and mounting. There continues to be a need for improved door jambs with the advantages of U.S. Pat. No. 6,500,193 and that provide for easy and speedy installation.

SUMMARY OF THE INVENTION

Therefore it is an object of the present invention to provide a bracket for use with a split jamb for supporting doors, windows and other similar objects, within both masonry and non-masonry constructed structures, that makes the split jamb relatively easy to install and less labor intensive than past split door jambs. Reference herein to "split jambs" or to "split door jambs" with respect to the present invention is understood to include split jambs for windows and similar objects as well as for doors.

It is another object of the invention to provide a split jamb that can be installed after the completion of a wall structure thereby facilitating a plumb and square installation and allowing for the split jamb to be installed in a "factory-finished" condition.

It is another object of the invention to provide a split jamb that can be installed in a wall structure so as to compensate for deviations in the construction of the wall structure.

It is another object of the invention to provide a split jamb having a unique mounting system that eliminates the need for a cementaceous filling to provide rigidity and that is easy to install.

It is another object of the invention to provide a split jamb in which only the size of the trim piece needs to be changed in order to accommodate various jamb depths.

It is another object of the invention to provide a split jamb that can be removed and replaced without any disruption to the wall structure or fixture, and can likewise replace a conventional support frame in an existing structure without any disruption to the structure or finish.

It is another object of the invention to provide a split jamb requiring fewer hardware reinforcements than conventional support frames.

It is another object of the invention to provide a split jamb and a method of using same that results in a finished installation.

It is another object of the invention to provide a split jamb capable of resisting fire for up to about three hours or more, when comprised of fire resistant materials such as, for example, steel.

These and other objectives of the present invention are achieved by providing a split jamb comprising a mechanical side or frame—the side that will bear the hardware such as hinges and latches for holding and securing a door or window (hereinafter the "support frame")—and an opposing side or frame—the side that mates with the mechanical side (hereinafter the "trim frame")—that is installed within an opening in a structure using a unique mounting system comprising the bracket of the invention. The support frame comprises two vertical side frame members that are positioned on respective vertical sides of a structure opening. Each of the side frame members includes at least one bracket of the invention for mounting the side frame members to the vertically extending walls of the structure that define the opening. One side frame member has at least one hinge pad for carrying a door or similar object to cover the opening. The vertical side frame members are connected by a laterally-extending top frame member.

The trim frame comprises two vertical side trim members that are mounted on and carried by respective side frame members of the support frame. Each trim member carries at least one bracket of the invention for connection to the side frame members to connect the trim frame and the support frame together to form a square and plumb split jamb. The vertical side trim members are connected by a laterally-extending top trim member.

According to one preferred embodiment of the invention, the split jamb is comprised of metal, such as steel or aluminum, for example, although other materials may alternatively be used, such as wood or plastic, for example. When a fire resistant jamb is desired, the jamb is most preferably comprised of steel or similar fire resistant material.

According to yet another preferred embodiment of the invention, a split jamb is provided comprising a support frame and a trim frame for being positioned in a predetermined size opening and mounted using at least one bracket of the invention. The support frame includes first and second opposed frame members for being positioned on respective first and second opposed sides of the opening, each of said first and second vertical side frame members include at least one bracket of the invention for mounting the first and second side frame members to first and second opposed walls defining the opening. The first frame member includes at least one hinge pad for carrying a structure covering the opening thereon. A third frame member connects the first and second frame members and extends perpendicularly thereto.

According to yet another preferred embodiment of the invention, each of the first and second vertical side frame members include a bracket of the invention for leveling and mounting the first and second side frame members to first and second opposed walls defining the opening.

An embodiment of the method of installing a frame in an opening defined by walls according to the invention comprises the steps of providing a split frame hollow opening assembly for being positioned in a predetermined size opening and comprising a support frame and a trim frame. The support frame includes first and second vertical side frame members for being positioned on respective first and second vertical sides of the opening, each of said first and second vertical side frame members including at least one bracket of the invention for leveling and mounting the first and second side frame members to first and second opposed, vertically-extending walls defining the opening plumb to the vertical. The first frame member includes at least one hinge pad for carrying a structure to cover the opening thereon. A laterally-extending top frame member connects the first and second vertically-extending side frame members perpendicularly thereto. The trim frame comprises first and second vertical side trim members for being mounted on and carried by respective first and second vertical side frame members.

The support frame is positioned in the opening. The first and second side frame members are trued to the vertical plumb and square. The support frame is then secured to the walls defining the opening. The trim frame is positioned in the opening and trued to the vertical. Finally, the support frame is secured to the trim frame with the bracket of the invention.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF PREFERRED EMBODIMENTS

Figure 1:
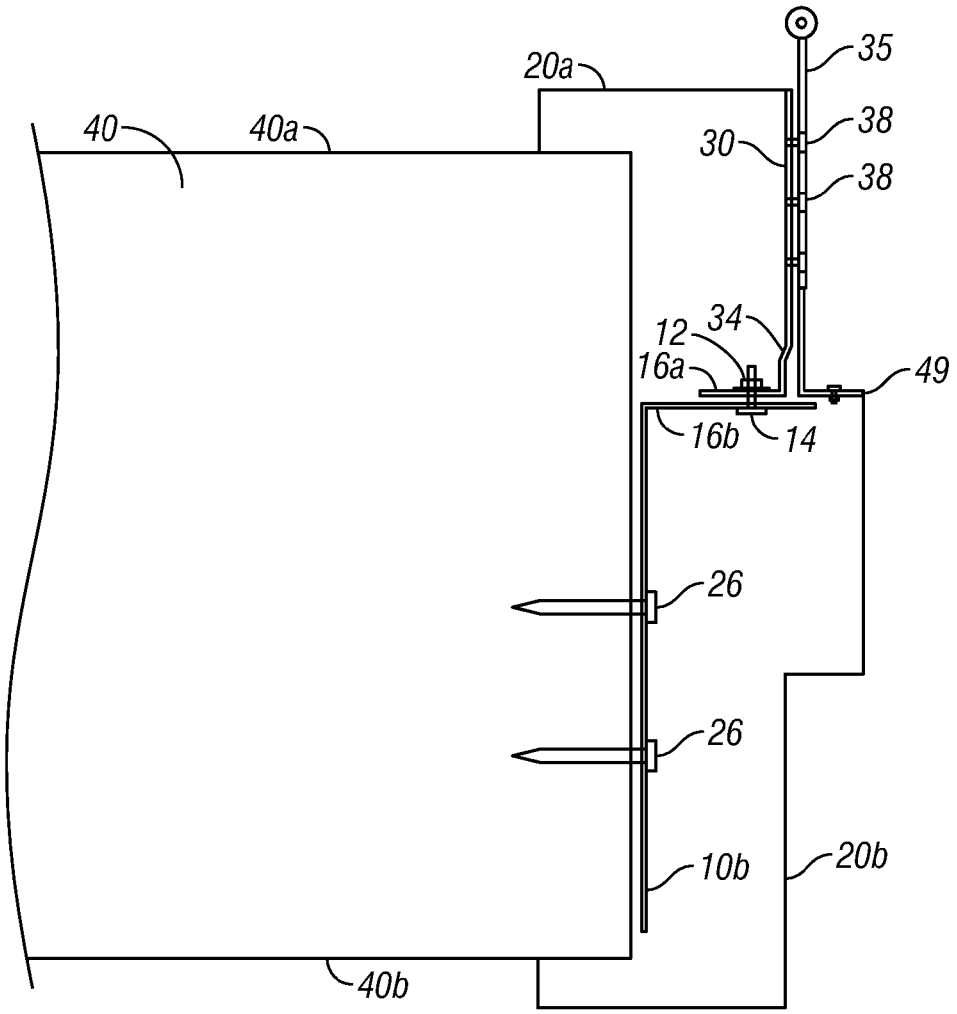
FIG. 1 is an enlarged fragmentary cross-sectional top view of the hinge side of an installed split door jamb of one embodiment of the present invention.
Figure 2:
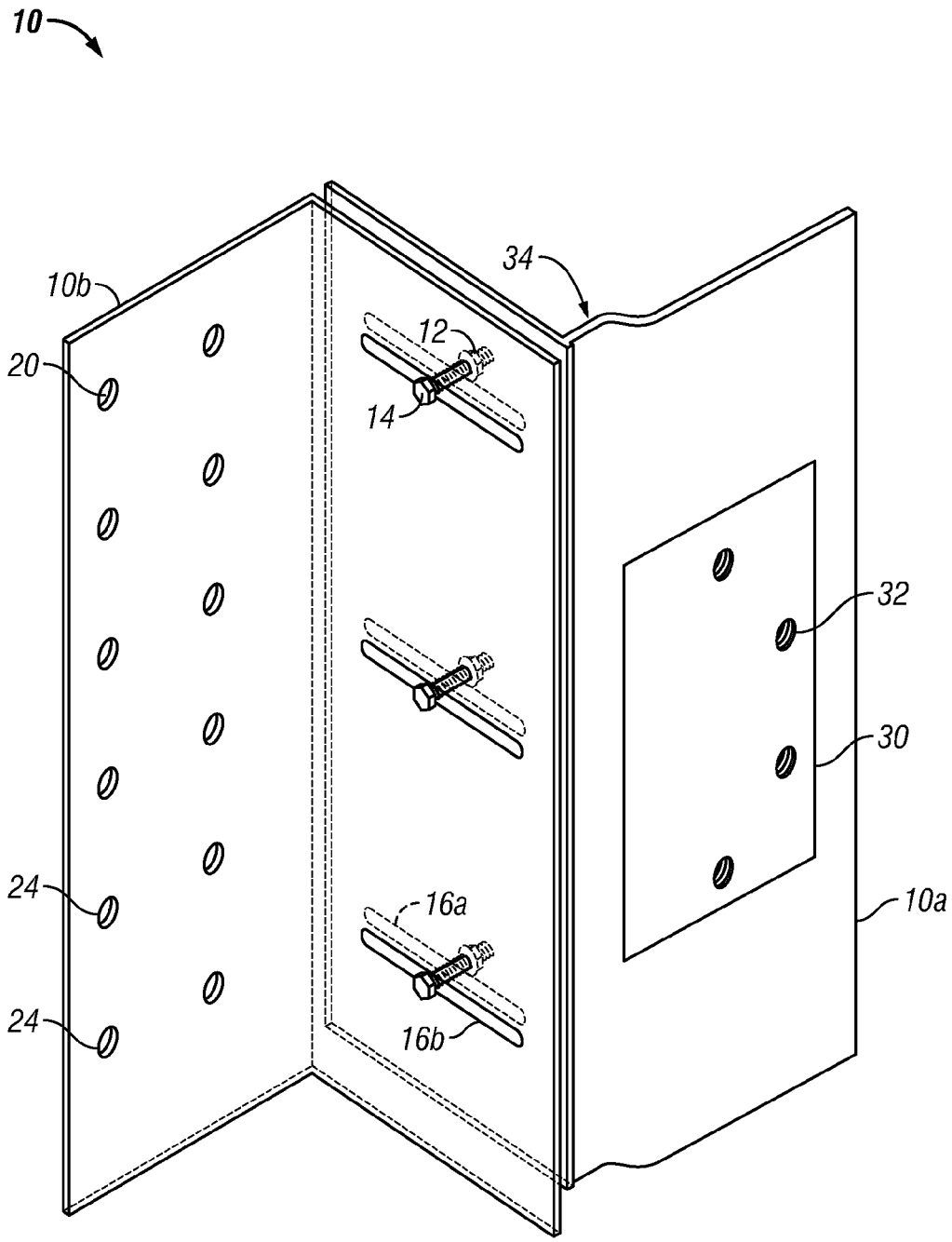
FIG. 2 is a perspective view of the bracket of the invention used to secure the support frame to the trim frame for installing a split door jamb of one embodiment of the present invention.

Referring now specifically to the drawings, FIGS. 1 and 2 depict the bracket 10 (also called a mounting bracket or a mounting or leveling bracket) of the invention that uniquely enables a split door jam frame to economically and efficiently accomplish the above stated objectives of the invention.

Figure 3A:
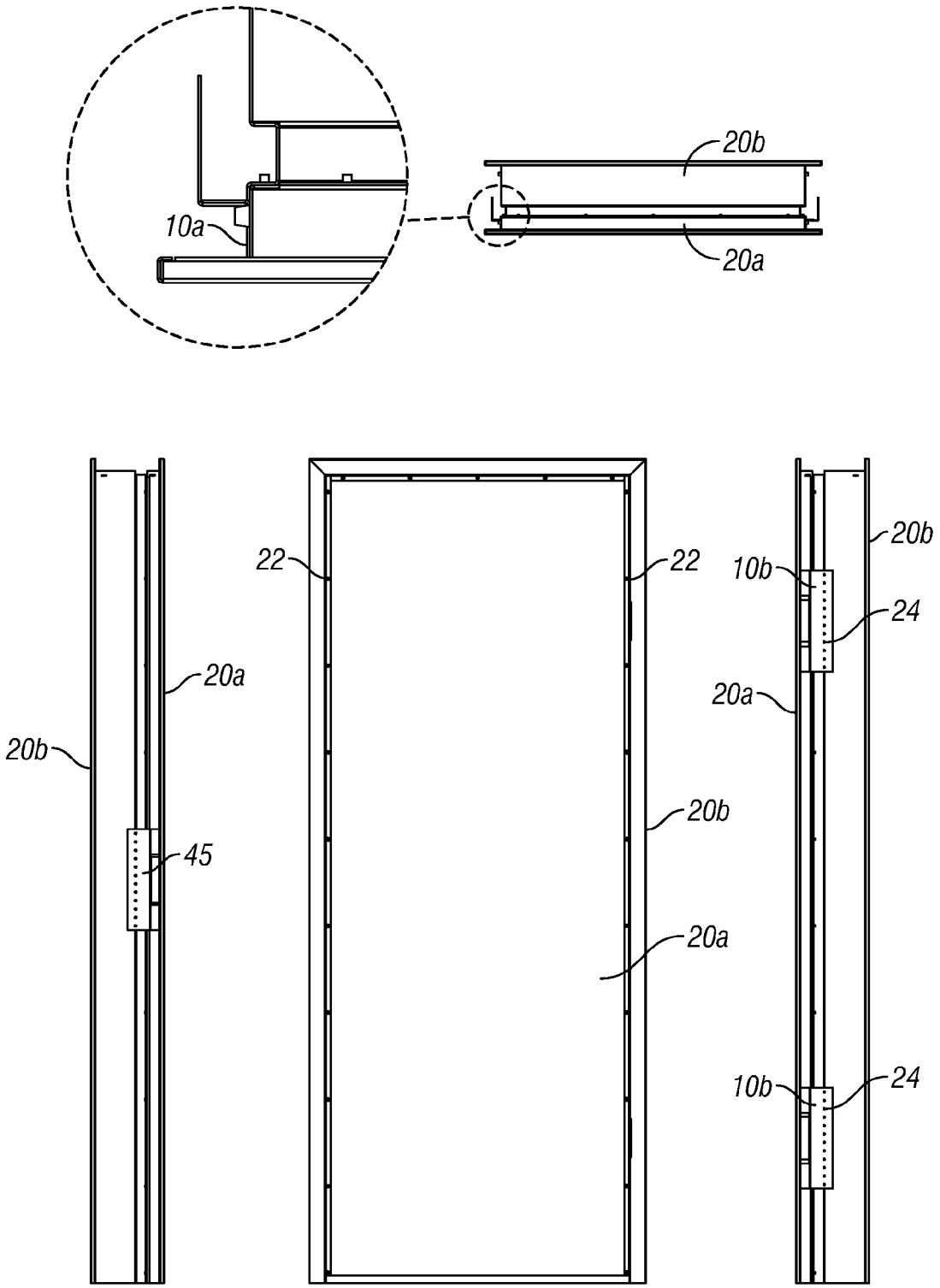
FIG. 3A is a latch side view, a front view and a side view of a split door jam of the present invention with an exploded view of the bracket of an alternative embodiment of the invention in place.
Figure 3B:
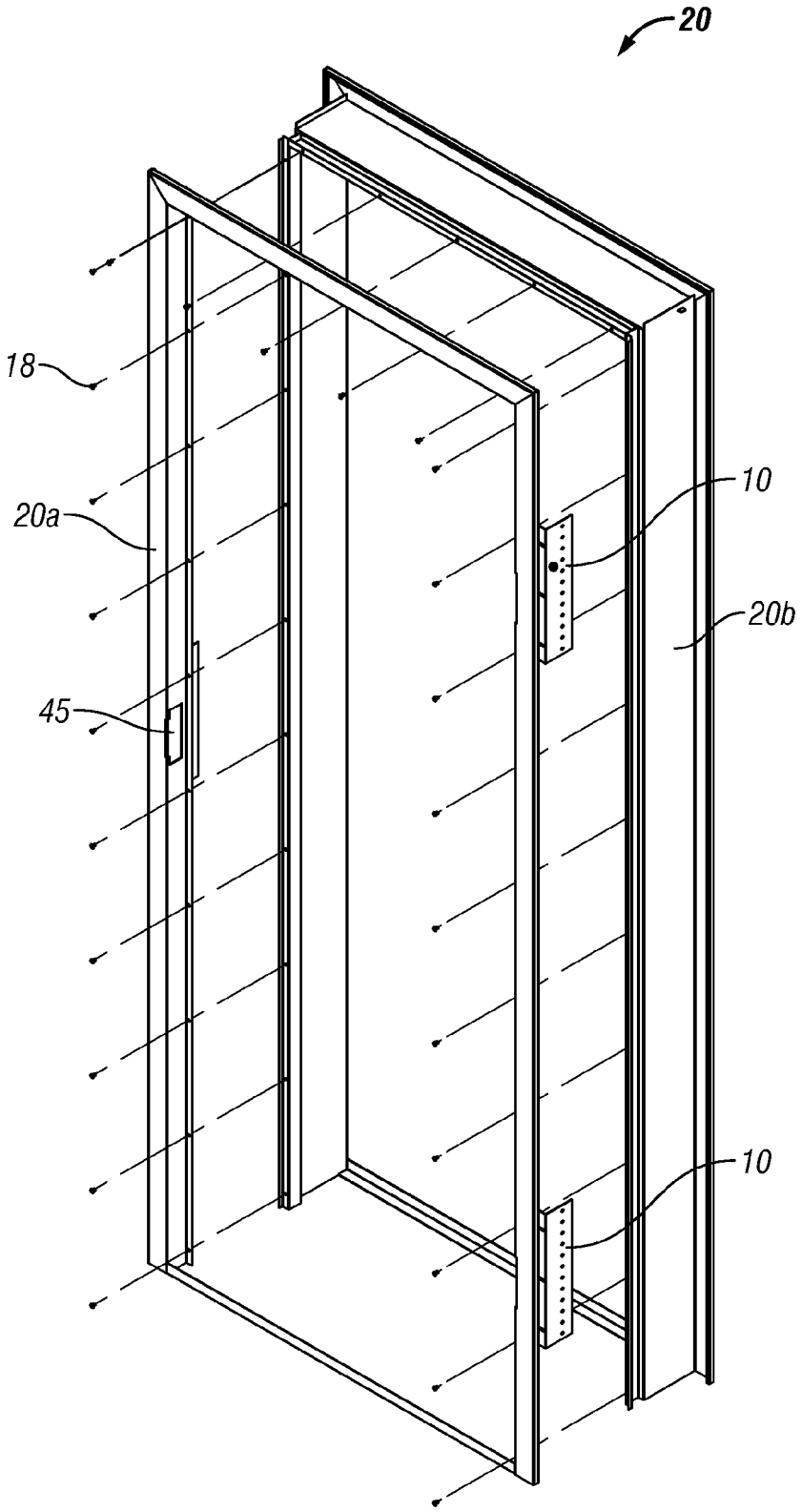
FIG. 3B is an exploded view of the split door jam of FIG. 3A showing the trim frame and the support frame separated and brackets of the invention attached to the trim frame.
Figure 4A:
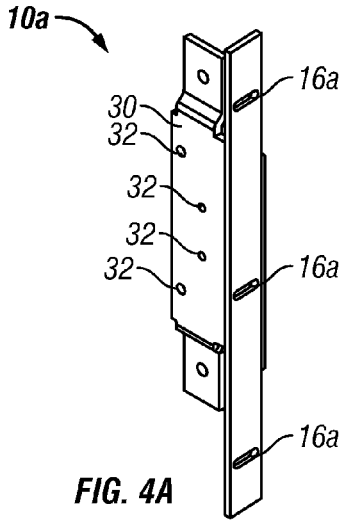
FIG. 4A is a perspective view of the piece of a bracket of one embodiment of the invention that connects to the hinge of a door to be installed in a door opening in a wall.
Figure 4B:
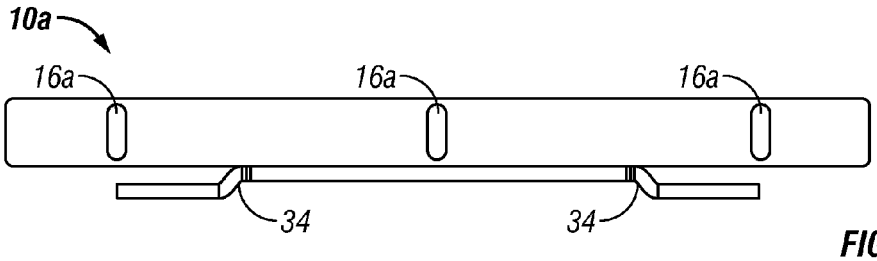
FIG. 4B is a top view of the bracket piece shown in FIG. 4A.
Figure 4C:
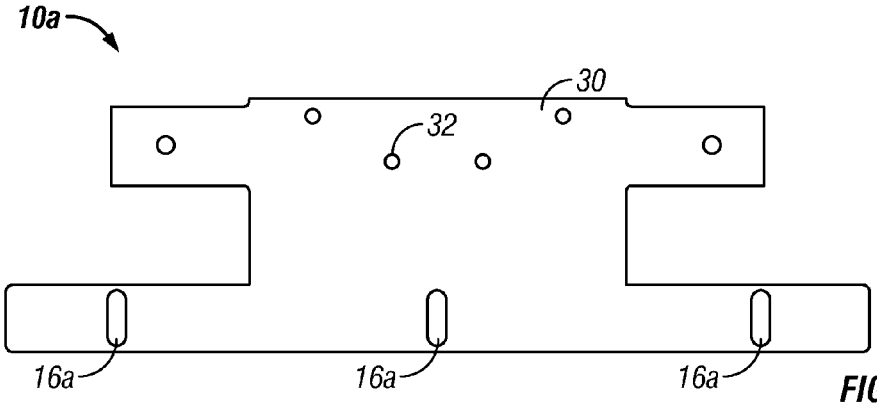
FIG. 4C is a side view of the bracket piece shown in FIG. 4A.
Figure 4D:
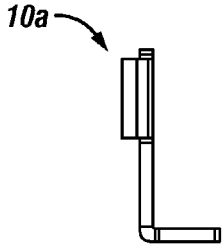
FIG. 4D is an end view of the bracket piece shown in FIG. 4A.
Figure 5A:
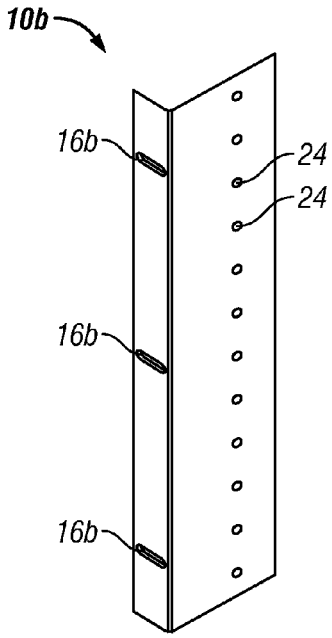
FIG. 5A is a perspective view of the piece of the bracket of one embodiment of the invention that connects to the wall in mounting a door in an opening in the wall.
Figure 5B:
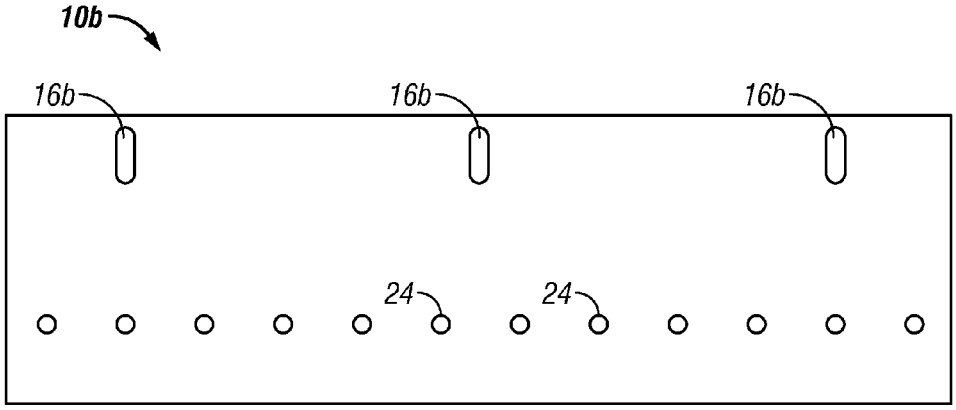
FIG. 5B is a side view of the bracket piece shown in FIG. 5A.
Figure 5C:
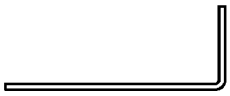
FIG. 5C is an end view of the bracket piece shown in FIG. 5A.

In FIG. 1, the bracket 10, comprising two generally "L-shaped" pieces 10A and 10B, is installed so as to connect a two-piece or split jamb metal door (or window) frame. A flange nut 12 and bolt 14 are shown securing the two pieces 10A and 10B of the bracket 10 together. A fastener equivalent to the nut 12 and bolt 14 could alternatively be used. The bracket 10 has slotted holes 16A and 16B (in bracket pieces 10A and 10B, respectively) at this position, as may be seen in more detail in FIG. 2, that afford adjustment and leveling of the split door jam frame 20. After leveling, the split door jam frame 20 is secured, or more particularly trim frame 20A is secured to support frame 20B, by mechanically fastening with a screw or pop rivet 18 through holes 22 as shown in FIGS. 3A and 3B.

FIGS. 1, 2, 3A, 3B, 4A, 4B, 4C, 4D, 5A, 5B and 5C show that one piece 10B of the bracket 10, typically on the support side or support frame 20A of the frame 20, has at least one and preferably a plurality of predrilled holes 24 for mounting the bracket 10 to wood studs, metal studs, or concrete or masonry wall with anchoring devices 26. The embodiment of the bracket piece 10B shown in FIG. 2 has two rows of holes 24 whereas an alternative embodiment of the bracket piece 10B in FIGS. 3A, 3B, 5A and 5B has a single row of holes 26, but otherwise these bracket pieces 10B are essentially and effectively the same. The exact number and positioning of holes 26 is not limiting but there should be a plurality of holes 26. Piece 10B of the bracket 10 is preferably welded to the frame 20 if the frame is metal, or may be screwed to the frame 20, particularly if the frame is wood or plastic. The other bracket piece 10A of the bracket 10 may have a hinge receiver 30 and preferably pretaped holes 32 through which may be inserted hinge screws 38. This piece 10A of the bracket 10 also has an offset 34 as shown in FIGS. 1, 2 and 4. The offset is sized to accommodate such that piece 10A can receive a hinge (or a latch) for a flush fitting overall. This offset 34 distorts the "L-shape" of piece 10A somewhat inside its 90 degree angle.

Figure 6A:
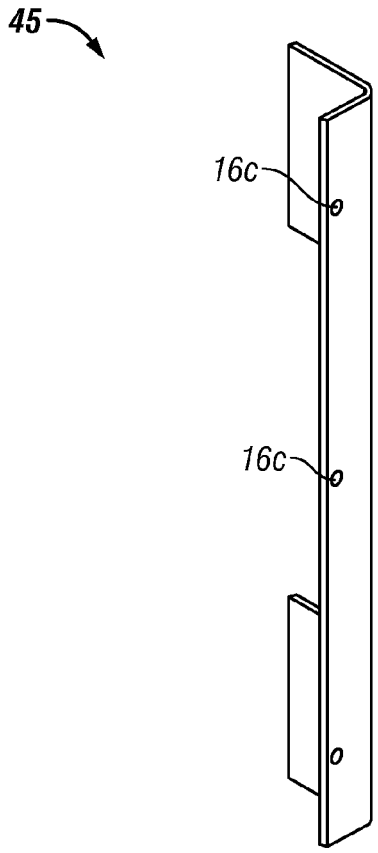
FIG. 6A is a perspective view of a bracket piece of one embodiment of the invention adapted for receiving a latch of the door (rather than a hinge) on the side of the door opposite the hinges in mounting a door in an opening in a wall.
Figure 6B:
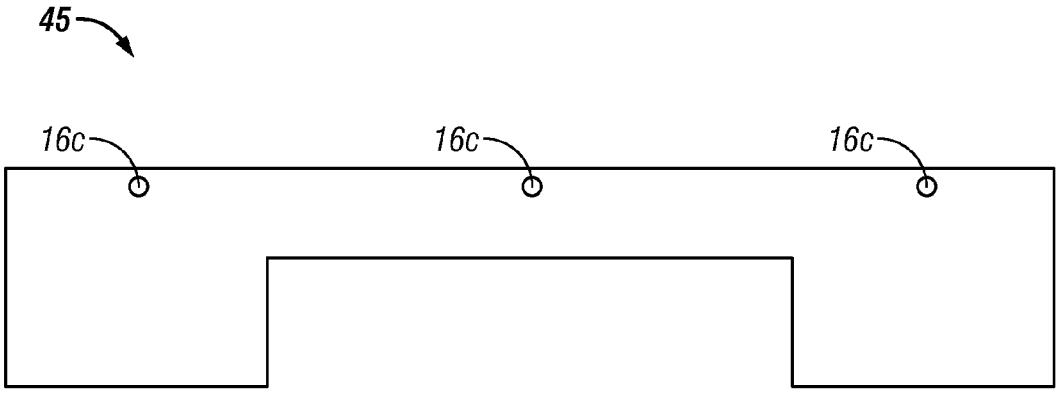
FIG. 6B is a side view of the bracket piece shown in FIG. 6A.
Figure 6C:
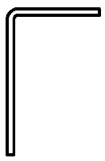
FIG. 6C is an end view of the bracket piece shown in FIG. 6A.

Referring to FIGS. 6A, 6B, and 6C, bracket piece 10A (as shown for example in FIGS. 4A and 4B), may be adapted to accommodate receiving a latch (see FIGS. 3A and 3B) instead of a hinge. Instead of slotted holes 16A, this adaption piece 45 has holes 16C, as shown in FIGS. 6A and 6B.

Referring again to FIG. 1, to assemble the split door jamb frame 20, the support frame 20B is positioned behind a door opening on the interior side 40B of a wall structure 40. The trim frame 20A is positioned facing the support frame 20B on the exterior side 40A of the wall structure 40. The support frame 20B is moved into a plumb and square position with the door opening. The plumb and square position of the support frame 20B is determined using industry accepted methods of installation that vary depending on the type of structure, masonry or non-masonry, on which the split door frame 10 is being mounted. As noted above, the slotted holes 16A and 16B in respective pieces 10A and 10B of the bracket 10 enable adjustment for leveling, and a nut 12 and bolt 14 (or equivalent fasteners) are used to secure the two pieces 10A and 10B of the bracket 10 together.

The bracket 10 of the invention is preferably about 12 inches in vertical length. The anchoring devices 26 are preferably integrated into the bracket 10 with hinge reinforcements. The anchoring devices 26 vary depending on the material of the wall structure on which the support frame is being mounted. For instance, anchoring devices 26 would preferably comprise wood screws when the wall structure is of wood construction. The anchoring devices 26 are driven into the wall structure 40 thereby securing the support frame 20B to the door opening. Since the split door jamb frame 20 is mounted in an active process, physically attached to the wall structure 40 with anchoring devices 26, there is no need for cementaceous filling material. As such, the split door jamb frame 20 can be quickly and easily removed without any disruption to the existing structure 40 and finishes. This characteristic enables the split door jamb frame 20 to be re-used, in remodeling an existing structure or even for use in another structure.

For installation, the trim frame 20A is positioned facing the support frame 20B such that the pop rivet or screws or other fasteners (securing devices) 18 on the support frame 20B are aligned with the receiving cavities 22 of the trim frame 10A, as shown in FIGS. 3A and 3B. Once aligned, these pop rivets, screws or other securing devices 18 are inserted into holes 22 defined by the active stops of the support frame 20B, and positioned to engage the trim frame 20A. Upon engagement, the trim frame 20A is secured to the support frame 20B. At this point, the installation of the split door jamb 20 is complete and a door can be mounted on hinges 35 at the hinge receiver 30 on the bracket piece 10A. A fire break 49 may optionally be included in the installation to extend the resistance of the door jam to fire.

Because the split door jamb frame 20 can be installed in a finished wall structure, it can be produced as a factory finished unit. In addition, the need for specially made parts is greatly reduced since various jamb depths and widths can be accommodated by the split door jamb frame 20. Adjustments needed for the width of wall are made in the trim frame 20A in advance of installation. Other adjustments to conform to variations in the door opening of the wall structure can be made on site, while maintaining the proper tolerance required to install the door within industry specifications. This alleviates the need for exacting dimensions and greatly reduces the labor intensity of door installation.

A split door jamb frame and method of using same is disclosed above. This description of the preferred embodiment of the invention and the best mode for practicing the invention are provided for the purpose of illustration only and not for the purpose of limitation. For example, the bracket of the invention is adaptable and might even be used as described without any split door jam at all, with the portion of the bracket that would be mounted to the trim frame instead just being mounted to the door and the portion of the bracket that would be mounted to the support frame instead just being mounted to the wall.

Other and various changes in the details described herein can be made without departing from the intended scope of this invention as defined by the appended claims.

I claim:

1. A split frame hollow opening assembly for being positioned in a wall opening for a door or window and comprising:

(a) a support frame, comprising:

(i) first and second vertical side frame members for being positioned on respective first and second vertical sides of the opening; and (ii) a laterally-extending top frame member connecting the first and second vertically-extending side frame members perpendicular thereto;

(b) a trim frame, comprising:

(i) first and second vertical side trim members for being mounted on and carried by respective first and second vertical side frame members; and (ii) a laterally-extending top trim member connecting the first and second vertically-extending side trim members perpendicular thereto; and (c) at least one pair of bracket pieces whereas the first bracket piece is approximately L-shaped and the second bracket piece is approximately L-shaped with an offset inside the angle of the piece, the first bracket piece comprising a plurality of holes on the longer side for mounting the bracket with anchoring devices to the wall and at least one hole or slot on the shorter side for connecting to the second bracket piece, and the second bracket piece comprising at least one hole or slot on the shorter side for connecting to the first bracket piece and a hinge receiver or latch receiver on the longer side for connecting to a hinge or a latch on the door or window.

2. The split frame hollow opening assembly of claim 1 wherein the first and second bracket pieces are connected with at least one nut and bolt.

3. The split frame hollow opening assembly of claim 1 comprised of metal or wood.

4. The split frame hollow opening assembly of claim 1 for a window further comprising:

a laterally-extending bottom frame member further connecting the first and second vertically-extending side frame members perpendicular thereto; and a laterally-extending bottom trim member further connecting the first and second vertically-extending side trim members perpendicular thereto.

5. The split frame hollow opening assembly of claim 1 wherein the shorter sides of both bracket pieces have multiple holes or slots for adjusting and leveling of the split frame hollow opening assembly.

6. The split frame hollow opening assembly of claim 1 further comprising a fire break.

7. The split frame hollow opening assembly of claim 1 wherein the support frame has securing devices and the trim frame has corresponding receiving cavities for aligning the support frame with the trim frame and securing the support frame to the trim frame.

8. The split frame hollow opening assembly of claim 7 wherein the securing devices comprise screws or pop rivets.

* * * * *